US006535103B1

(12) United States Patent
Duggal et al.

(10) Patent No.: US 6,535,103 B1
(45) **Date of Patent: *Mar. 18, 2003**

(54) CURRENT LIMITING ARRANGEMENT AND METHOD

(75) Inventors: Anil Raj Duggal, Niskayuna, NY (US); Lionel Monty Levinson, Niskayuna, NY (US)

(73) Assignee: General Electric Company, Niskayuna, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 910 days.

(21) Appl. No.: 08/810,055

(22) Filed: Mar. 4, 1997

(51) Int. Cl.[7] ..... H01C 7/10
(52) U.S. Cl. ..... 338/22 R
(58) Field of Search ..... 338/20, 21, 22 R, 338/225 D, 99, 112, 114, 115, 47; 361/126, 135; 29/610.1

(56) References Cited

U.S. PATENT DOCUMENTS

| | | | | |
|---|---|---|---|---|
| 3,226,600 A | 12/1965 | Zielasek | ..... | 315/209 |
| 3,243,753 A | 3/1966 | Kohler | ..... | 338/31 |

(List continued on next page.)

FOREIGN PATENT DOCUMENTS

| | | |
|---|---|---|
| DE | 4330607 | 3/1995 |
| EP | 0640995 | 3/1995 |
| EP | 0713227 | 5/1996 |
| EP | 0747910 | 12/1996 |
| WO | 9112643 | 8/1991 |
| WO | 9119297 | 12/1991 |
| WO | 9321677 | 10/1993 |
| WO | 9410734 | 5/1994 |
| WO | 9534931 | 12/1995 |
| WO | 9749102 | 12/1997 |

OTHER PUBLICATIONS

Duggal et al., Appl. Phys. Lett. 71 (14), Oct. 6, 1997, "High Power Switching Behavior in Electrically Conductive Polymer Composite Materials", pp. 1939–1941.

Ford et al., J. Appl. Phys. 61 (6), Mar. 15, 1987, Positive Temperature Coefficient Resistors as High–Power Pulse Switches: Performance Limitations, Temperature Effects, and Triggering Behavior, pp. 2381–2386.

Duggal et al., Journal of Applied Physics, vol. 83, No. 4, Feb. 15, 1998, The Initiation of High Current Density Switching in Electrically Conductive Polymer Composite Materials, pp. 2046–2051.

Duggal et al., J. Appl. Phys. 82 (11), Dec. 1, 1997, A Novel High Current Density Switching Effect in Electrically Conductive Polymer Composite Materials, pp. 5532–5539.

"Accurate Placement and Retention of an Amalgam in an Electrodeless Fluorescent Lamp", Borowiec et al., Ser. No. 08/448,080 (RD–24425FW) filed May 23, 1995. (Date considered as admitted art as of filing).

*Primary Examiner*—Karl D. Easthom
(74) *Attorney, Agent, or Firm*—Toan P. Vo; Noreen C. Johnson

(57) ABSTRACT

A current limiting arrangement comprises at least two electrodes and at least two electrically conductive composite materials. The current limiting arrangement has predetermined operational bounds. The at least two composite materials each comprising a low pyrolysis temperature binder and an electrically conductive filler. The at least two conductive composite materials are in parallel with one another. Each conductive composite material has electrical and physical characteristics that define operational bounds, and at least two conductive composite materials having at least one different characteristic. A total of the electrical and physical characteristics of the at least two conductive composite materials being substantially similar to the operational bounds of the current limiting arrangement.

10 Claims, 3 Drawing Sheets

U.S. PATENT DOCUMENTS

| | | | | | |
|---|---|---|---|---|---|
| 3,648,002 | A | | 3/1972 | Du Rocher | 200/166 C |
| 3,673,121 | A | | 6/1972 | Meyer | 252/511 |
| 3,878,501 | A | * | 4/1975 | Moorhead et al. | 338/22 R |
| 4,017,715 | A | | 4/1977 | Whitney et al. | 219/553 |
| 4,101,862 | A | | 7/1978 | Takagi et al. | 338/23 |
| 4,107,640 | A | | 8/1978 | Asano et al. | 338/23 |
| 4,237,441 | A | | 12/1980 | van Konynenburg et al. | 338/22 R |
| 4,292,261 | A | | 9/1981 | Kotani et al. | 264/24 |
| 4,304,987 | A | | 12/1981 | van Konynenburg | 219/553 |
| 4,317,027 | A | | 2/1982 | Middleman et al. | 219/553 |
| 4,583,146 | A | | 4/1986 | Howell | 361/13 |
| 4,685,025 | A | | 8/1987 | Carlomagno | 361/106 |
| 4,890,186 | A | | 12/1989 | Matsubara et al. | 361/103 |
| 4,939,498 | A | * | 7/1990 | Yamada et al. | 338/22 R |
| 5,057,674 | A | | 10/1991 | Smith-Johannsen | 219/553 |
| 5,068,634 | A | | 11/1991 | Shrier | 338/21 |
| 5,166,658 | A | | 11/1992 | Fang et al. | 338/23 |
| 5,247,276 | A | | 9/1993 | Yamazaki | 338/22 R |
| 5,260,848 | A | | 11/1993 | Childers | 361/127 |
| 5,313,184 | A | | 5/1994 | Greuter et al. | 338/21 |
| 5,382,938 | A | | 1/1995 | Hansson et al. | 338/22 R |
| 5,414,403 | A | | 5/1995 | Greuter et al. | 338/22 R |
| 5,416,462 | A | | 5/1995 | Demarmels et al. | 338/22 R |
| 5,432,140 | A | | 7/1995 | Sumpter et al. | 502/167 |
| 5,436,274 | A | | 7/1995 | Sumpter et al. | 521/88 |
| 5,451,919 | A | | 9/1995 | Chu et al. | 338/22 R |
| 5,545,679 | A | | 8/1996 | Bollinger, Jr. et al. | |
| 5,581,192 | A | | 12/1996 | Shea et al. | 324/722 |
| 5,602,520 | A | | 2/1997 | Baiatu et al. | 338/22 R |
| 5,644,283 | A | | 7/1997 | Grosse-Wilde et al. | 338/20 |
| 5,777,541 | A | | 7/1998 | Vekeman | |

* cited by examiner

CURRENT LIMITING ARRANGEMENT AND METHOD

BACKGROUND OF THE INVENTION

1. Field of the Invention

This invention relates to a current limiting arrangement for general circuit protection including electrical distribution and motor control applications. In particular, the invention relates to a current limiting arrangement that is capable of limiting the current in a circuit when a high current condition occurs.

2. Description of Related Art

There are numerous devices that are capable of limiting the current in a circuit when a high current condition occurs. One known limiting device includes a filled polymer material which exhibits what is commonly referred to as a PTCR (positive-temperature coefficient of resistance) or PTC effect. U.S. Pat. Nos. 5,382,938, 5,313,184, and European Published Patent Application No. 0,640,995 A1 each describe an electrical device relying on PTC behavior. The unique attribute of the PTCR or PTC effect is that at a certain switch temperature the PTCR material undergoes a transformation from a basically conductive material to a basically resistive material. In some of these prior current limiting devices, the PTCR material (typically polyethylene loaded with carbon black) is placed between pressure contact electrodes.

U.S. patent application Ser. No. 08/514,076, filed Aug. 11, 1995, now U.S. Pat. No. 5,614,881 issued Mar. 25, 1997, the entire contents of which are herein incorporated by reference, discloses a current limiting device. This current limiting device relies on a composite material and inhomogeneous distributions of resistance structure.

Current limiting devices are used in many applications to protect sensitive components in an electrical circuit from high currents. Applications range from low voltage and low current electrical circuits to high voltage and high current electrical distribution systems. An important requirement for many applications is a fast current limiting response to minimize the peak fault high current that develops.

In operation, current limiting devices are placed in a circuit to be protected. Under normal circuit conditions, the current limiting device is in a highly conducting state. When a high current condition occurs, the PTCR material heats up through resistive heating until the temperature is above the "switch temperature". At this point, the PTCR material resistance changes to a high resistance state and the high current condition current is limited. When the high current condition is cleared, the current limiting device cools down over a time period, which can be long, to below the switch temperature and returns to the highly conducting state. In the highly conducting state, the current limiting device is again capable of switching to the high resistance state in response to future high current condition events.

Known current limiting devices include conducting composite material comprising at least one of a low pyrolysis or vaporization temperature polymeric binder and an electrically conducting filler combined with inhomogeneous distributions of resistance structure. The switching action of these current limiting devices occurs when joule heating of the electrically conducting filler in the relatively higher resistance part of the composite material causes sufficient heating to cause pyrolysis or vaporization of the binder, that occurs at a predetermined point in time after the switching occurs.

A conductive composite material possesses electrical and physical characteristics that define the operational limits or bounds for a current limiting device. For an optimum operation of a current limiting device in an intended use and application, a conductive composite material should possess many desirable criteria and properties in order to enable a wide range of uses. The desirable criteria and properties include, but are not limited to, a low bulk and contact resistance so as to have an adequate low power dissipation when the current limiting device is in an unswitched state; a relatively short switching time and a relatively high switched resistance during a high current condition event to adequately limit the high current condition current; and a relatively high energy absorbing capacity to absorb high current condition energy during a high current condition event.

It is relatively difficult to obtain a single conductive composite material that satisfies all desirable criteria and properties for particular applications of a current limiting device, so the current limiting device has satisfactory operational bounds. A single composite material may possess one or more of the desirable criteria and properties for an intended use of the current limiting device, however it is not likely that a single conductive composite material possesses all desired criteria and properties for a particular application and intended use of a current limiting device, so the current limiting device has satisfactory operational bounds.

For example, but not limited to, a single conductive composite material will possess a low bulk and contact resistance to have an adequate low power dissipation when the current limiting device is in an unswitched state. However, it is unlikely that the single conductive composite material will possess a relatively short switching time or a relatively high switched resistance during a high current condition event to adequately limit the high current condition current. Another conductive composite material will possess a relatively high energy absorbing capacity to absorb a high current condition energy during a high current condition event, but fail to provide a low bulk and contact resistance so as to have an adequate low power dissipation when the current limiting device is in an unswitched state. Thus, the operational bounds of a current limiting device will be limited by the conductive composite material in the current limiting device, and a current limiting device that needs all of these criteria for successful operations will not be obtained.

The lack of a single conductive composite material with all desirable criteria and properties for an intended use and application of a current limiting device, of course, makes it difficult to obtain a current limiting device with optimum operational bounds. Since a single conductive composite material will not normally possess all desirable criteria and properties, known current limiting devices will have limited uses and applications, dependent on the conductive composite material.

SUMMARY OF THE INVENTION

Accordingly, it is desirable to provide a current limiting arrangement that overcomes the above, and other, disadvantages of known current limiting devices.

Accordingly, it is desirable to provide a current limiting arrangement that utilizes at least two electrically conductive composite materials, with a resistance distribution structure in a current limiting device. The multiple and distinct electrically conductive composite materials are chosen considering the intended use and application of the current limiting device, thus allowing optimization of various desirable properties and criteria for a successful current limiting operation. The operational parameter bounds for the intended use and application on each composite material in a current limiting arrangement are reduced by combining the individual desirable properties of the conductive composite materials. Since no single conductive composite material is needed to exhibit all desirable properties and criteria in a current limiting device for the intended use and application, the combination of conductive composite materials lends to a desirable current limiting arrangement.

DETAILED DESCRIPTION OF THE INVENTION

Figure 1:
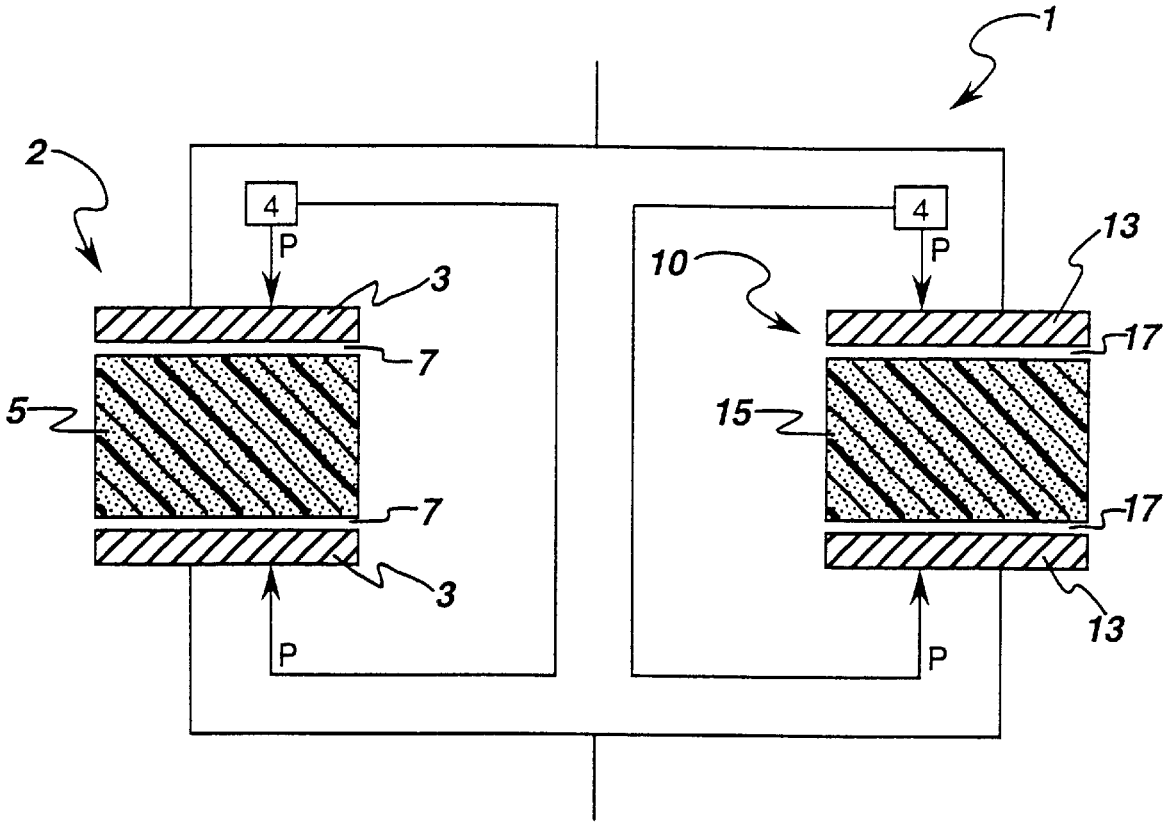
FIG. 1 is a side cross-sectional drawing of a current limiting arrangement with multiple and distinct electrically conductive composite materials.

In general, a current limiting device comprises at least two electrodes and an electrically conductive composite material between the at least two electrodes, and resistance distribution structure, which is not homogenous, throughout the device. In order for a current limiting device to be reusable, the resistance distribution structure is arranged so at least one thin layer of the current limiting device is perpendicular to the direction of current flow. The resistance distribution structure has a much higher resistance than an average resistance for an average layer of the same size and orientation.

Additionally, a current limiting device is normally under compressive pressure in a direction perpendicular to the selected thin high resistance layer. The compressive pressure is inherent in the current limiting device. Alternatively, the compressive pressure is exerted by a resilient structure, assembly or device, such as but not limited to a spring.

The conductive composite material comprises at least one of a low pyrolysis temperature binder and conducting filler that is pressure contacted to electrodes. There can be significant contact resistance between the material and one or both electrodes.

In operation, a current limiting device is placed in the electrical circuit to be protected. During normal operation, the resistance of the current limiting device is low, i.e., the resistance of the current limiting device would be equal to the resistance of the highly conducting composite material plus the resistance of the electrodes plus the contact resistance. When a high current condition occurs, a high current density starts to flow through the device. In initial stages of the high current condition, the resistive heating of the device is believed to be adiabatic. Thus, it is believed that the selected thin, more resistive layer of the current limiting device heats up much faster than the rest of the current limiting device. With a properly designed thin layer, it is believed that the thin layer heats up so quickly that at least one of thermal expansion of and gas evolution from the thin layer causes a separation within the current limiting device at the thin layer.

The resistance distribution structure is arranged so that at least one thin layer positioned perpendicular to the direction of current flow has a predetermined resistance, which is at least about ten percent (10%) greater than an average resistance for an average layer of the same size and orientation. Further, the resistance distribution structure is positioned proximate to at least one electrode electrically conductive composite material interface. However, the scope of the invention includes any suitable construction where a higher resistance is anywhere between the electrodes.

Each conductive composite material possess specific electrical and physical characteristics, which define the operational bounds for a current limiting device. These electrical and physical characteristics include, but are not limited to, a low bulk and contact resistance so as to have an adequate low power dissipation when the current limiting device is in an unswitched state; a relatively short switching time and a relatively high switched resistance during a high current condition event to adequately limit the high current condition current; and a relatively high energy absorbing capacity to absorb the high current condition energy during a high current condition event. Therefore, each conductive composite material defines the bounds of operation for a current limiting device.

Each application and intended use of a current limiting device has specific criteria or operational bounds that are to be met for a satisfactory operation. The conductive composite material defines the operational bounds for a current limiting device through its electrical and physical characteristics. As discussed above, it is difficult to obtain a single conductive composite material that possesses all of the desired properties and characteristics for an intended use and application for a current limiting device. A single conductive composite material possesses some, but not all, of the desirable properties for an intended use and application of the current limiting device. Accordingly, the current limiting device has a limited range of use, which is defined by the conductive composite material.

Accordingly, the invention provides for a current limiting arrangement that comprises at least two conductive composite materials in combination. The conductive composite materials, in combination, provide a desired totality of criteria and properties for an intended use and application of the current limiting arrangement meeting the operational bounds of the intended use and application.

The combination of at least two conductive composite materials, rather than relying on a single conductive composite material, enhances the operational bounds of the current limiting arrangement.

The properties of the at least two conductive composite materials in the current limiting arrangement are selected so a parallel combination of the at least two conductive composite materials exhibits desirable overall operational bounds and performance characteristics for the intended use of the current limiting arrangement. Since the combination of at least two conductive composite materials possesses desirable properties for an intended use and application of the current limiting arrangement, it is not necessary that any one conductive composite material exhibit all desired properties for that particular current limiting arrangement's operational bounds for the intended use and application.

For example, but in no way limiting the invention, it is desired that a current limiting arrangement possess operational bounds including a predetermined unswitched resistance, switching time and switched resistance, and be capable of handling the desired energy input that occurs during switching. A first conductive composite material may possess a desirable unswitched resistance, switching time and switched resistance. However, the first electrically conductive composite material is not capable of handling the desired energy input that occurs during switching. A second conductive composite material is capable of handling the required energy input and has an adequate switching time and switched resistance. However, the second conductive composite material does not possess a desirable unswitched resistance.

Therefore, each of the above described first and second conductive composite materials, respectively, do not individually possess the totality of desirable properties for the operational bounds for an intended use of the current limiting device. However, a combination of the two conductive composite materials will possess the desired operational bounds for the intended use and application of the current limiting device.

A first embodiment of a current limiting arrangement 1, as embodied in the invention illustrated in FIG. 1, will now be discussed. The current limiting arrangement 1 comprises at least two current limiting devices 2 and 10, respectively, connected in parallel. The current limiting device 2 comprises an electrically conductive composite material 5, which comprises at least one of a low pyrolysis temperature and low vaporization temperature binder; an electrically conducting filler combined with a resistance distribution structure 7 and electrodes 3. A compressive pressure or force P may also be applied to the current limiting device 2 by a force applying device 4. Although, a force applying device 4 is provided, the force applying device 4 is not necessary if the current limiting device 2 has a sufficient inherent self-applying compressive force. Further, the resistance distribution structure 7 is located anywhere between the electrodes 3.

The current limiting device 10 of the current limiting arrangement 1 comprises an electrically conductive composite material 15, which possess at least one different electrical or physical property from the conductive composite material 5, and comprises at least one of a low pyrolysis temperature and a vaporization temperature binder; an electrically conducting filler combined with a resistance distribution structure 17 and electrodes 13. A compressive pressure or force P may also be applied to the current limiting device 10 by a force applying device 4. Although, a force applying device 4 is provided, the force applying device 4 is not necessary if the current limiting device 10 has a sufficient inherent self-applying compressive force. Also, the resistance distribution structure 17 is located anywhere between the electrodes 13.

The electrically conductive composite materials 5 and 15, each possess individual electrical and physical characteristics, which would define the operational bounds for a current limiting device, if each conductive composite material were used individually in a current limiting device. However, the conductive composite materials 5 and 15, in combination and in parallel, exhibit a combined totality of electrical and physical characteristics to met the desired operational bounds of the current limiting arrangement's use and application.

By way of example but not to be construed as limiting of the invention, a conductive composite material 5 will provide a low bulk and contact resistance so as to have an adequate low power dissipation when the current limiting device is in an unswitched state, a relatively short switching time and a relatively high switched resistance during a high current condition event to adequately limit the high current condition current, but a relatively low energy absorbing capacity making it unable to absorb the high current condition energy during a high current condition event without material failure. The conductive composite material 15 will provide a relatively short switching time and a relatively high switched resistance during a high current condition event to adequately limit the high current condition current and a relatively high energy absorbing capacity to absorb the high current condition energy during a high current condition event but not a low bulk and contact resistance so as to have an adequate low power dissipation when the current limiting device is in an unswitched state. Therefore, while individually each conductive composite material would not fulfill the operational bounds for the intended use and application of the current limiting arrangement, the combination of the conductive composite materials 5 and 15 provide, the desired operational bounds for the intended use and application of the current limiting systems.

The operation of a current limiting arrangement 1, as embodied in FIG. 1, will now be discussed with reference to FIG. 2. FIG. 2 is a graph of resistance versus time for the current limiting arrangement 1. The current limiting device 2 in the current limiting arrangement 1 possesses a relatively low steady state resistance R1, which is desirable, however it is less robust or operationally stable when it switches to its high switched resistance state R4. The current limiting device 10 in the current limiting arrangement 1 possesses a steady state resistance R2, which is higher than the steady state resistance R1, however is more robust than the current limiting device 2 and also possesses a lower switched high current condition resistance R3.

In operation, at time t0, current is applied to the current limiting arrangement 1. The current in the current limiting arrangement 1 is directed to flow primarily through the current limiting device 2 because of the lower steady state resistance R1. The current in the current limiting arrangement 1 flows primarily through the current limiting device 2 until a high current event occurs.

At time t1, a high current event occurs. The current limiting device 2 switches from a steady state resistance condition and reaches a high current state resistance condition. The resistance of the current limiting device 2 quickly increases to resistance R4, which is significantly higher than the steady state resistances R1 and R2.

At time t1, when the current limiting device 2 reaches its current limiting high resistance state R4, the current in the current limiting arrangement 1 is directed to flow primarily through the path of least resistance, i.e., through the current limiting device 10, which has a steady state resistance R2. The steady state resistance R2 is lower than the high current event resistance R4 of the current limiting device 2, and thus defines the path of least resistance in the current limiting arrangement 1. This shunting of current away from the current limiting device 2 as it switches, reduces the amount of energy absorbed by the current limiting device 2, thereby allowing it to operate without failure.

Therefore, after time t1, the current in the current limiting arrangement 1 is directed to flow primarily through the current limiting device 10 at the steady state resistance R2. In the example illustrated in FIG. 2, the current in the current limiting arrangement 1 will continue to be directed to flow primarily through the current limiting device 10, even when the current limiting device 10 changes from a steady state resistance R2 to a switched high current event resistance R3 at time t2. The current will continue to be directed to flow primarily through the current limiting device 10 because the current limiting device 10 remains the path of least resistance, even at its high current event resistance R3, which is lower than the high current event resistance R4 of the current limiting device 2.

Figure 2:
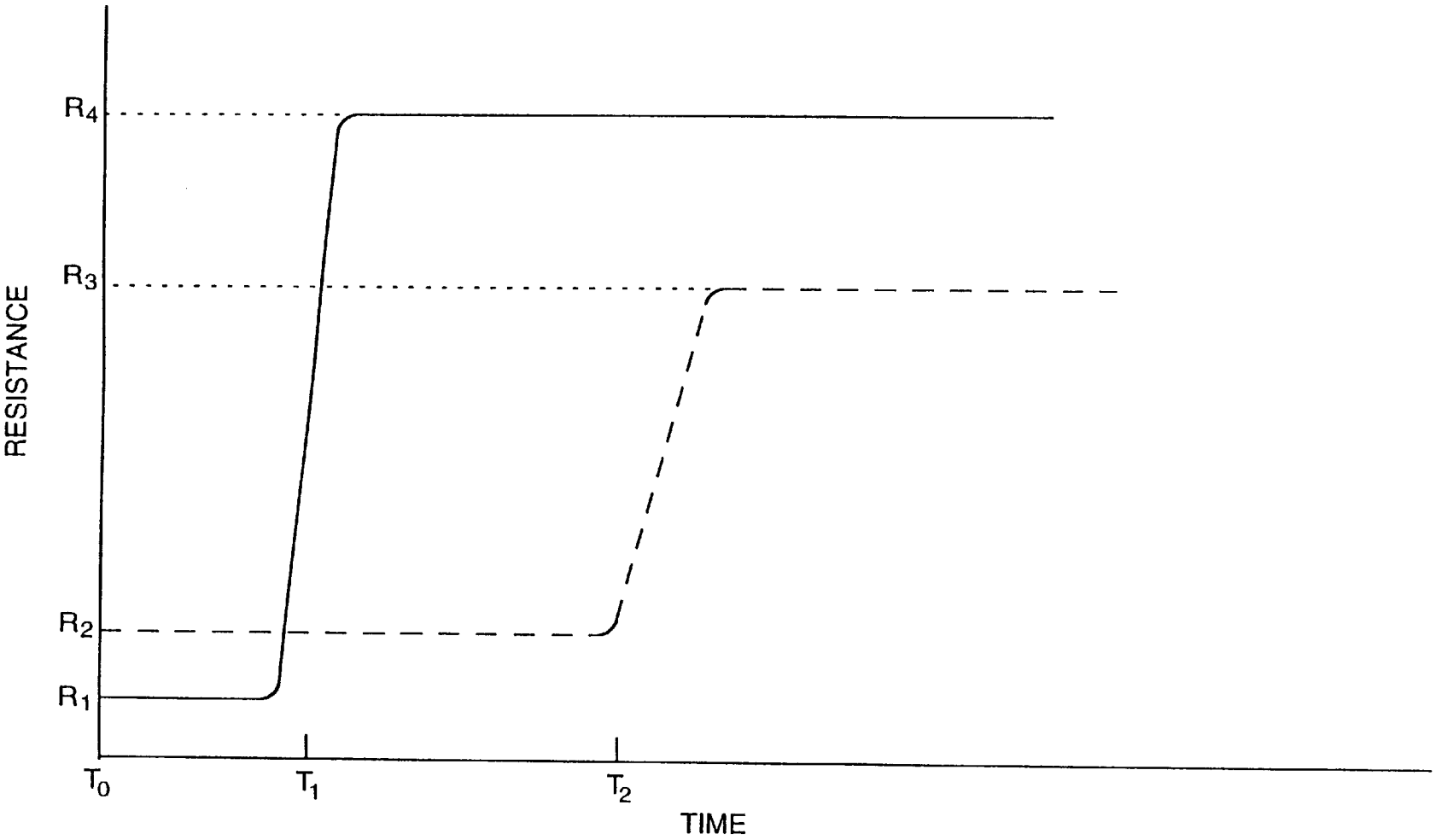
FIG. 2 is a graph of resistance versus time for a current limiting arrangement as embodied in the invention.

However, the configuration illustrated in FIG. 1 is merely exemplary, and is in no way limiting of the structure of the invention. For example, the high current event resistance of the current limiting device 10 may be higher than the high current event resistance of the current limiting device 2. In this situation, the current would then be directed to flow primarily through the path of least resistance, a path through the current limiting device 2. Therefore, with a two composite conductive material configuration of a current limiting arrangement as embodied in the invention, the current limiting arrangement will have a steady state resistance of ((R1R2)/(R1+R2)), and would reach a switched resistance of ((R3R4)/(R3+R4)), without material failure.

Further, although FIG. 1 illustrates the current limiting arrangement 1 comprising two current limiting devices 2 and 10 in parallel, a current limiting arrangement as embodied in the invention comprises two or more current limiting devices in parallel. This arrangement obtains a desirable combination of properties and characteristics in the current limiting arrangement to expand the operation bounds of the current limiting arrangement. The design and any number of current limiting devices in a current limiting arrangement is dependent on desired operational bounds of the current limiting arrangement, and the electrical and physical characteristics of the conductive composite materials of each of the current limiting devices.

Figure 3:
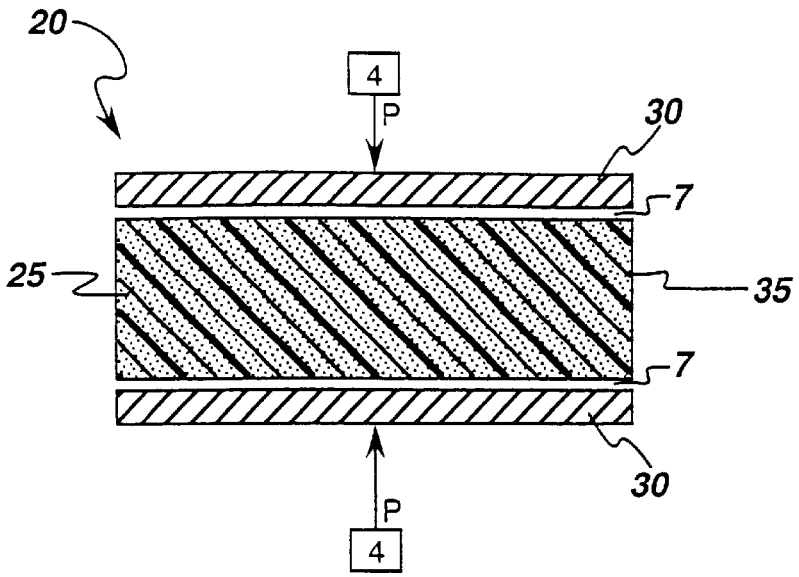
FIG. 3 is a side cross-sectional drawing of a second embodiment of a current limiting arrangement with multiple and distinct electrically conductive composite materials.

Furthermore, as embodied a further embodiment of the invention, and illustrated in FIG. 3, a current limiting arrangement 20 comprises a current limiting device 30. In FIG. 3, like reference characters refer to like features, as discussed in FIG. 1. The current limiting device 30 comprises two electrodes 31 with resistance distribution structure 7 between the electrodes.

In the embodiment illustrated in FIG. 3, the current limiting arrangement 20 comprises two distinct conductive composite materials 25 and 35. Each conductive composite material 25 and 35 respectively, has its own electrical and physical characteristics to define operational bounds. In combination, the conductive composite materials 25 and 35, respectively, provide the desired combination of criteria and properties for the intended use and application's operational bounds of the current limiting arrangement 20, similar to the combination of conductive composite materials discussed in the current limiting arrangement 1 of FIG. 1.

In the current limiting arrangement 20 of FIG. 3, the conductive composite materials 25 and 35 are not spaced from each other, and share common electrodes 31. The conductive composite materials 25 and 35 need not be physically spaced from one another, since the current will inherently flow to the path of least resistance, even if the conductive composite material are in physical contact.

Figure 4:
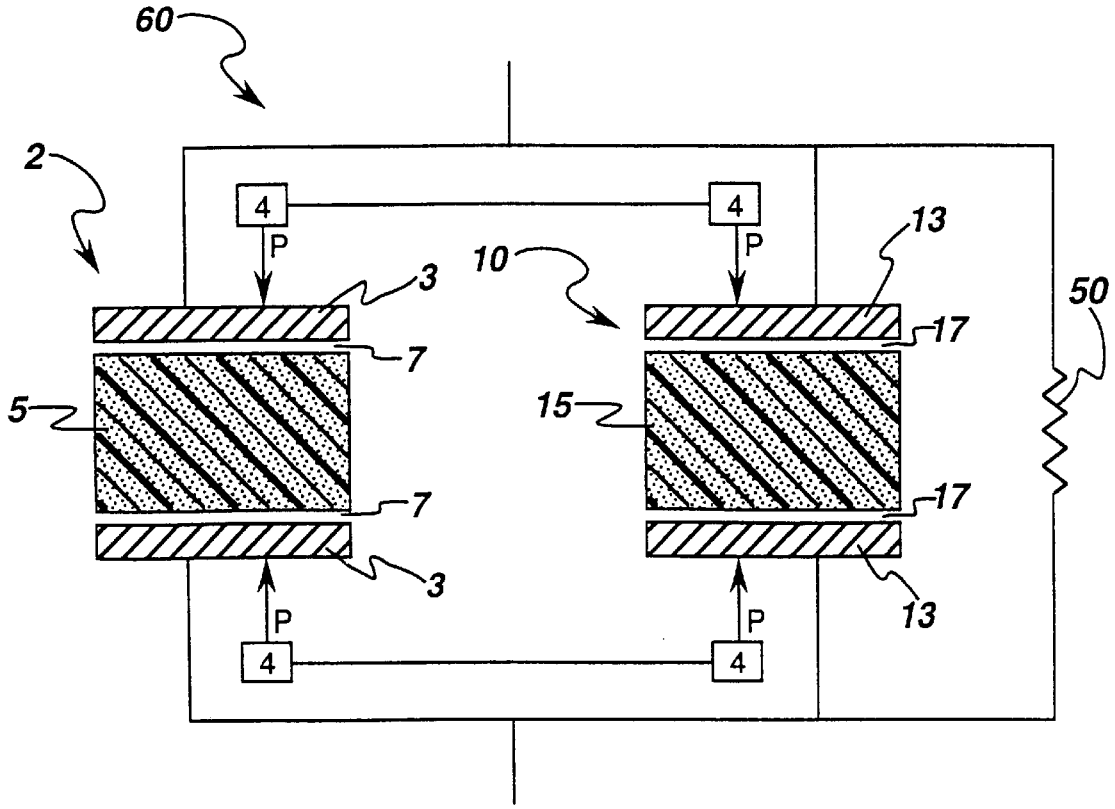
FIG. 4 is a side cross-sectional drawing of a third embodiment of a current limiting arrangement with multiple and distinct electrically conductive composite materials.

A further embodiment of the invention is illustrated in FIG. 4, which illustrates a current limiting arrangement 60, similar to FIG. 1. However, a resistor 50 is placed in parallel with the parallel current limiting devices 2 and 10, so as to direct current through the intended path of least resistance in the current limiting arrangement 60, regardless of a high current event. The resistor 50 can be any appropriate resistor, including but not limited to a linear variable resistor, a varistor, resistive circuitry and similar resistive structures.

The binder in the conductive composite materials is chosen so that significant gas evolution occurs at a low, i.e. less than about 800° C., temperature. An inhomogeneous distribution structure is typically selected so that at least one selected thin layer of the current limiting device has much higher resistance than the rest of the current limiting device.

It is believed that the advantageous results of the conventional current limiting device are obtained because, during a high current condition, adiabatic resistive heating of this selected thin layer followed by rapid thermal expansion and gas evolution from the binding material leads to a partial or complete physical separation of the current limiting device that produces a higher over-all device resistance to electric current flow. Thus, the current limiting device limits the flow of current through the high current condition current path. Other components of the electrical circuit are not harmed by the high current condition.

There is an inhomogeneous resistance distribution structure in the material throughout the current limiting device. For the current limiting device to be reusable, the resistance structure distribution in the material can be arranged so that at least one thin layer of the current limiting device 1 is positioned perpendicular to a direction of normal current flow, and has a higher resistance than for an average layer of the same size and orientation. The resistance distribution structure in the material is preferably arranged so that at least one thin layer positioned perpendicular to the direction of current flow has a resistance at least about ten percent (10%) greater than the average resistance for an average layer of the same size and orientation. The resistance distribution structure in the material is preferably positioned proximate the interface of the electrodes and electrically conductive composite material.

The current limiting arrangement, as embodied in the invention, is typically under compressive pressure P in a direction perpendicular to the selected thin high resistance layer. The compressive pressure may be inherent in the current limiting arrangement or applied by an external apparatus 4, assembly or device. The external apparatus 4 need not be employed, dependent on an extent of inherent resilience in the current limiting arrangement itself. However, such a compressive pressure P insures the contact between the electrodes and conductive composite material.

The conductive composite material comprises at least one of a low pyrolysis or vaporization temperature binder and an electrically conducting filler combined with inhomogeneous resistance distribution structure, that may be under compressive pressure P. The binder is chosen such that significant amount of gas evolution occurs at a low (less that approximately 800° C.) temperature. The inhomogeneous resistance distribution structure is typically chosen so that at least one selected thin layer of the current limiting device has much higher resistance than the rest of the current limiting device.

A binder material for use in the current limiting device as embodied in the invention preferably has a low pyrolysis or vaporization temperature, for example about less than 800° C. Binder materials comprise, but are not limited to, a thermoplastic, for example, polytetrafluoroethylene, poly (ethyleneglycol), polyethylene, polycarbonate, polyimide, polyamide, polymethylmethacrylate, and polyester; a thermoset plastic, for example, epoxy, polyester, polyurethane, phenolic, and alkyd; an elastomer, for example, silicone (polyorganosiloxane), (poly)urethane, isoprene rubber, and neoprene; an organic or inorganic crystal; alone or combined with an electrically conducting filler, such as a ceramic, metal, for example but not limited to, nickel, silver, silver and aluminum, aluminum, and copper; or a semiconductor, for example, carbon black, and titanium dioxide, could also perform effectively in the current limiting device of the invention. Further, a filler material with a particulate or foam structure is also envisioned in this invention.

Third phase fillers can be included in the current limiting device to improve specific properties of the composite material. As embodied in the invention, these third phase fillers include fillers to improve mechanical properties; dielectric properties; or to provide arc-quenching properties or flame-retardant properties. Materials that could be used as a third phase fillers in the composite material comprise: a filler selected from reinforcing fillers, such as fumed silica; or extending fillers, such as precipitated silica and mixtures thereof. Other fillers include titanium dioxide, lithopone, zinc oxide, diatomaceous silicate, silica aerogel, iron oxide, diatomaceous earth, calcium carbonate, silazane treated silicas, silicone treated silicas, glass fibers, magnesium oxide, chromic oxide, zirconium oxide, alpha-quartz, calcined clay, carbon, graphite, cork, cotton sodium bicarbonate, boric acid, and alumina-hydrate.

Other additives may be included in the current limiting device as embodied in the invention. These include impact modifiers for preventing damage to the current limiting device, such as cracking upon sudden impact; flame retardants for preventing flame formation and/or inhibiting flame formation in the current limiting device; dyes and colorants for providing specific color components in response to customer requirements; UV screens for preventing reduction in component physical properties due to exposure to sunlight or other forms of UV radiation.

The invention contemplates that combinations of current limiting devices, as set forth in the above description of the invention, may be used together to obtain desirable operational characteristics and properties for the intended use and application. Further, invention also contemplates that for current limiting arrangements, as embodied in the invention, electrically conducting materials other than metals, such as but not limited to ceramics and intrinsically conducting polymers, can be used for conductive features of the invention.

Other embodiments of the invention will be apparent to those skilled in the art from a consideration of this specification or practice of the invention disclosed herein. It is intended that the specification and examples be considered as exemplary only, with the true scope and spirit of the invention being indicated by the following claims.

What is claimed is:

1. A current limiting arrangement having operational bounds, the current limiting arrangement comprising:

a first electrode set comprising first and second electrodes and a first electrically conductive composite material between the first and second electrodes;

a second electrode set comprising third and fourth electrodes and a second electrically conductive composite material between the third and fourth electrodes, the first electrically conductive composite material and the second electrically conductive material each comprising a low pyrolysis temperature binder and an electrically conductive filler, the first electrically conductive composite material and the second electrically conductive material being electronically in parallel with one another, the first electrically conductive composite material being in physical and electrical contact with the first and second electrodes at first electrode set interfaces disposed between the first electrically conductive composite material and the first and second electrodes, and the second electrically conductive material being in physical and electrical contact with third and fourth electrodes at second first electrode set interfaces disposed between the second electrically conductive composite material and the third and fourth electrodes, the first electrically conductive composite material and the second electrically conductive composite material are spaced from each other, and the first electrode set and the second electrode set are spaced from each other with the first electrically conductive composite material and the second electrically conductive composite material;

first compressive pressure applying means for exerting pressure on the first electrode set;

second compressive pressure applying means for exerting pressure on the second electrode set, the first compressive pressure applying means being separate and distinct from the second compressive pressure applying means:

the first electrically conductive composite material possessing first electrical conductive characteristics that define operational bounds for the first electrically conductive composite material and the second electrically conductive composite material possessing second electrical conductive characteristics that define operational bounds for the second electrically conductive composite material, where at least one of the first electrical conductive characteristics of the first electrically conductive composite material differs from at least one of the second electrical conductive characteristics of the second electrically conductive composite material, and a total of the first and second electrical conductive characteristics define combined operational bounds that equal the operational bounds of the current limiting arrangement.

2. The current limiting arrangement according to claim 1, wherein the first electrically conductive composite material and the second electrically conductive composite material are spaced from each other.

3. The current limiting arrangement according to claim 1, further comprising a resistive structure in parallel with the first electrically conductive composite material and the second electrically conductive composite material.

4. The current limiting arrangement according to claim 3, wherein the resistive structure comprises a linear resistor.

5. The current limiting arrangement according to claim 1, wherein the first electrode set and the first electrically conductive material defines a first steady state resistance, and the second electrode set and the second electrically conductive material defines a second steady state resistance that is lower that the first steady state resistance.

6. A method of providing a current limiting arrangement, the method comprising:

defining operational bounds of the current limiting arrangement;

providing a first electrode set comprising first and second electrodes and a first electrically conductive composite material between the first and second electrodes and a second electrode set comprising third and fourth electrodes and a second electrically conductive composite material between the third and fourth electrodes;

providing the first electrically conductive composite material and the second electrically conductive material being electronically in parallel with one another, the first electrically conductive composite material and the second electrically conductive composite material are spaced from each other, and the first electrode set and the second electrode set are spaced from each other with the first electrically conductive composite material and the second electrically conductive composite material:

providing first compressive Pressure applyina means for exerting pressure on the first electrode set;

providing second compressive pressure applying means for exerting pressure on the second electrode set, the first compressive pressure applying means being separate and distinct from the second compressive pressure applying means;

providing the first electrically conductive composite material being in physical and electrical contact with the first and second electrodes at first electrode set interfaces disposed between the first electrically conductive composite material and the first and second electrodes, and the second electrically conductive material being in physical and electrical contact with third and fourth electrodes at first electrode set interfaces disposed between the second electrically conductive composite material and the third and fourth electrodes; and providing the first electrically conductive composite material possessing first electrical conductive characteristics that define operational bounds for the first electrically conductive composite material and the second electrically conductive composite material possessing second electrical conductive characteristics that define operational bounds for the second electrically conductive composite material, where at least one of the first electrical conductive characteristics of the first electrically conductive composite material differs from at least one of the second electrical conductive characteristics of the second electrically conductive composite material, and a total of the first and second electrical conductive characteristics: define combined operational bounds that equal the operational bounds of the current limiting arrangement.

7. The method according to claim 6, further comprising disposing the first electrically conductive composite material and the second electrically conductive composite material spaced from each other.

8. The method according to claim 6, further comprising disposing a resistive structure in parallel with the first electrically conductive composite material and the second electrically conductive composite material.

9. The method according to claim 8, wherein the resistive structure comprises a linear resistor.

10. The method according to claim 6, wherein the first electrode set and the first electrically conductive material defines a first steady state resistance, and the second electrode set and the second electrically conductive material defines a second steady state resistance that is lower that the first steady state resistance.

* * * * *